US007831191B2

(12) United States Patent
Mandel

(10) Patent No.: US 7,831,191 B2
(45) Date of Patent: Nov. 9, 2010

(54) PRINTING SYSTEM AND METHOD

(75) Inventor: Barry P Mandel, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 540 days.

(21) Appl. No.: 12/024,531

(22) Filed: Feb. 1, 2008

(65) Prior Publication Data

US 2009/0194926 A1 Aug. 6, 2009

(51) Int. Cl.
*G03G 15/00* (2006.01)

(52) U.S. Cl. ..... 399/385; 399/381; 399/391; 399/384; 271/9.01; 271/9.13

(58) Field of Classification Search ..... 399/381, 399/384, 385, 391, 382; 271/9.1, 9.01, 9.13
See application file for complete search history.

(56) References Cited

U.S. PATENT DOCUMENTS 5,386,283 A * 1/1995 Yang et al. ..... 399/385
5,875,383 A * 2/1999 Stemmle ..... 399/384
6,229,983 B1 * 5/2001 Sawada ..... 399/385
6,934,507 B2 * 8/2005 Ohki et al. ..... 399/406
2003/0189280 A1 10/2003 Stevens
2005/0158094 A1 7/2005 Mandel et al.

FOREIGN PATENT DOCUMENTS

JP 63 231961 9/1988
JP 2000 117691 4/2000
JP 2005 250273 9/2005

* cited by examiner

*Primary Examiner*—Ren Yan
*Assistant Examiner*—Matthew G Marini
(74) *Attorney, Agent, or Firm*—Fay Sharpe LLP

(57) ABSTRACT

A printing system includes a first sheet media source dispensing a length of sheet media and a second sheet media source dispensing pre-cut sheets of media. A merging unit is operative to receive the length of sheet media and position pre-cut sheets of media along the same. A marking unit receives and marks images on the length of sheet media as well as the pre-cut sheets positioned thereon. A separating unit is adapted to separate the pre-cut sheets from the length of sheet media. A cutting unit is adapted to divide the length of sheet media into marked and unmarked sheets of media. A sheet receiving unit is operative to receive the marked sheets of media and the pre-cut sheets of media. A method of printing on continuous feed and pre-cut sheet media is also included.

24 Claims, 4 Drawing Sheets

PRINTING SYSTEM AND METHOD

BACKGROUND

The subject matter of the present disclosure broadly relates to the art of printing systems and, more particularly, to a printing system capable of marking on an extended length of sheet media together with pre-cut sheets of media, and a method of using the same.

Printing systems that utilize a continuous length of sheet material are well known and commonly used for production of larger volume print jobs. That is, such printing systems are often employed for print jobs in which a significant quantity of a single document is to be produced. Typically, such printing systems require substantial time, effort and cost to setup in preparation for the production of a given print job. As a result, continuous feed printing systems, as such systems are commonly referred to in the art, are often deemed to be less well suited for producing a relatively small number of copies of a given document.

Conventional continuous feed printing systems are supplied by extended lengths of sheet media, which are commonly provided in bulk roll form. Such lengths of sheet media are sometimes referred to as webs by those of skill in the art. One benefit of utilizing such a printing system is that the frequent resupplying of pre-cut sheets of media is avoided. Thus, such continuous feed printing systems, once setup for production, can sustain operation for long periods of time, which can help to increase productivity and reduce production costs.

In some cases, however, a document may call for one or more pages that are printed on sheet media having different properties and/or characteristics than that of the continuous length of sheet media being supplied to the printing system. For example, such pages may call for sheet media of a different size, a different weight or thickness and/or a different type or material than that of the length of sheet media being supplied to the printing system. Unfortunately, the efficiencies and cost savings that might otherwise be associated with the production of such a document on a continuous feed printing system are often significantly reduced due to the call for sheets of media having these different properties and/or characteristics.

In such cases, these additional pages of the document may be produced on a different printing system or, in some cases, at a different time on the same printing system. Regardless of whether these additional pages are produced on the same or a different printing system, however, one disadvantage of this situation is that additional time, effort and cost is often involved in setting up a printing system for the production of these additional sheets or pages. Additionally, these separate sheets or pages are then typically added as inserts into or otherwise combined with the sheets of the document produced on the continuous feed printing system. Such inserting operations are also costly and time consuming, in many cases. As such, these situations in which at least a portion of a document is to be printed on a separate printing system and/or at a separate time can often undesirably increase production expenses and/or lead time for production of documents.

Accordingly, it is believed desirable to develop a printing system capable of marking on an extended length of sheet media together with pre-cut sheets of media, and a method of using the same that overcomes the foregoing and/or other issues.

BRIEF DESCRIPTION

A printing system in accordance with the subject matter of the present disclosure is provided that includes a first media source supplying a longitudinally-extending length of sheet media having opposing first and second surfaces. The printing system also includes a second media source supplying pre-cut sheets of media and a merging unit operatively disposed along the length of sheet media. The merging unit is adapted to receive the pre-cut sheets of media from the second media source and position the pre-cut sheets of media in longitudinally-spaced relation to one another along the first side of the length of sheet media. A marking unit is operatively disposed along the length of sheet media and is adapted to mark images on the pre-cut sheets of media as well the length of sheet media thereby generating pre-cut sheets of marked media as well as marked and unmarked portions of the length of sheet media with the unmarked portions extending beneath the pre-cut sheets of marked media. A separating unit is operatively disposed along the length of sheet media and is adapted to separate the pre-cut sheets of marked media from the length of sheet media and thereby expose the unmarked portions of the length of sheet media. A cutting unit is operatively disposed along the length of sheet media. The cutting unit is operative to sever the length of sheet media into individual sheets of media such that marked sheets of media are formed from the marked portions of the length of sheet media and unmarked sheets of media are formed from the unmarked portions of the length of sheet media. A sheet collection unit is adapted to receive at least the marked sheets of media from the cutting unit and the pre-cut sheets of marked media from the separating unit.

A printing system in accordance with the subject matter of the present disclosure is provided that includes a continuous sheet media source that is operative to dispense a length of sheet media and a cut sheet media source that is adapted to dispense pre-cut sheets of media. A marking unit is adapted to generate marked images on the length of sheet media and the pre-cut sheets of media and a sheet media collection unit is adapted to receive cut sheets of media. A transport pathway operatively connects the continuous sheet media source, the sheet media collection unit, the marking unit and the cut sheet media source. The transport pathway includes a merge portion operatively disposed between the continuous sheet media source and the marking unit. The merge portion is adapted to receive and selectively position pre-cut sheets of media along the length of sheet media such that the pre-cut sheets of media can be conveyed in operative association along the marking unit together with the length of sheet media. A separator portion is operatively disposed between the marking unit and the sheet media collection unit. The separator portion is adapted to separate the pre-cut sheets of media from the length of sheet media.

A method of printing a multi-sheet document in accordance with the subject matter of the present disclosure is provided that includes providing a length of sheet media and a quantity of pre-cut sheets of media. The method also includes positioning one or more of the quantity of pre-cut sheets of media along the length of sheet media. The method further includes moving the length of sheet media together with the pre-cut sheets of media through a printing system and thereby generating marked pre-cut sheets of media and marked portions of the length of sheet media. The method also includes separating the marked pre-cut sheets of media from the length of sheet media. The method further includes cutting at least the marked portions of the length of sheet media into individual sheets of marked media. The method further includes collecting the marked pre-cut sheets of media and the individual sheets of marked media into a multi-sheet document.

DETAILED DESCRIPTION

The terms "print", "printing," "mark" and "marking" as used herein are to be broadly interpreted to encompass any action or process involving the production and/or output of sheet media having text, images, graphics and/or any other indicia formed thereon by any process, such as inkjet or electrophotographic processes, for example.

The terms "printer" and "printing system" as used herein are to be broadly interpreted to encompass any device, apparatus or system that is capable of performing a "printing" action. Examples of such equipment and/or systems include, without limitation, desktop printers, network printers, standalone copiers, multi-function printer/copier/facsimile devices, high-speed printing/publishing systems and digital printing presses.

Additionally, such exemplary embodiments of equipment, systems and/or processes can utilize sheet media of any suitable size, shape, type, kind, material, quality, weight and/or thickness (e.g., recycled paper, plain paper, bond paper, coated paper, card stock, transparencies and/or other media). Furthermore, such exemplary equipment, systems and/or processes can output indicia on such sheet media using any printing or marking substance, such as liquid ink, solid ink, toner and/or colorant, for example, in monochrome (e.g., black) or one or more colors, or any combination thereof.

Figure 1:
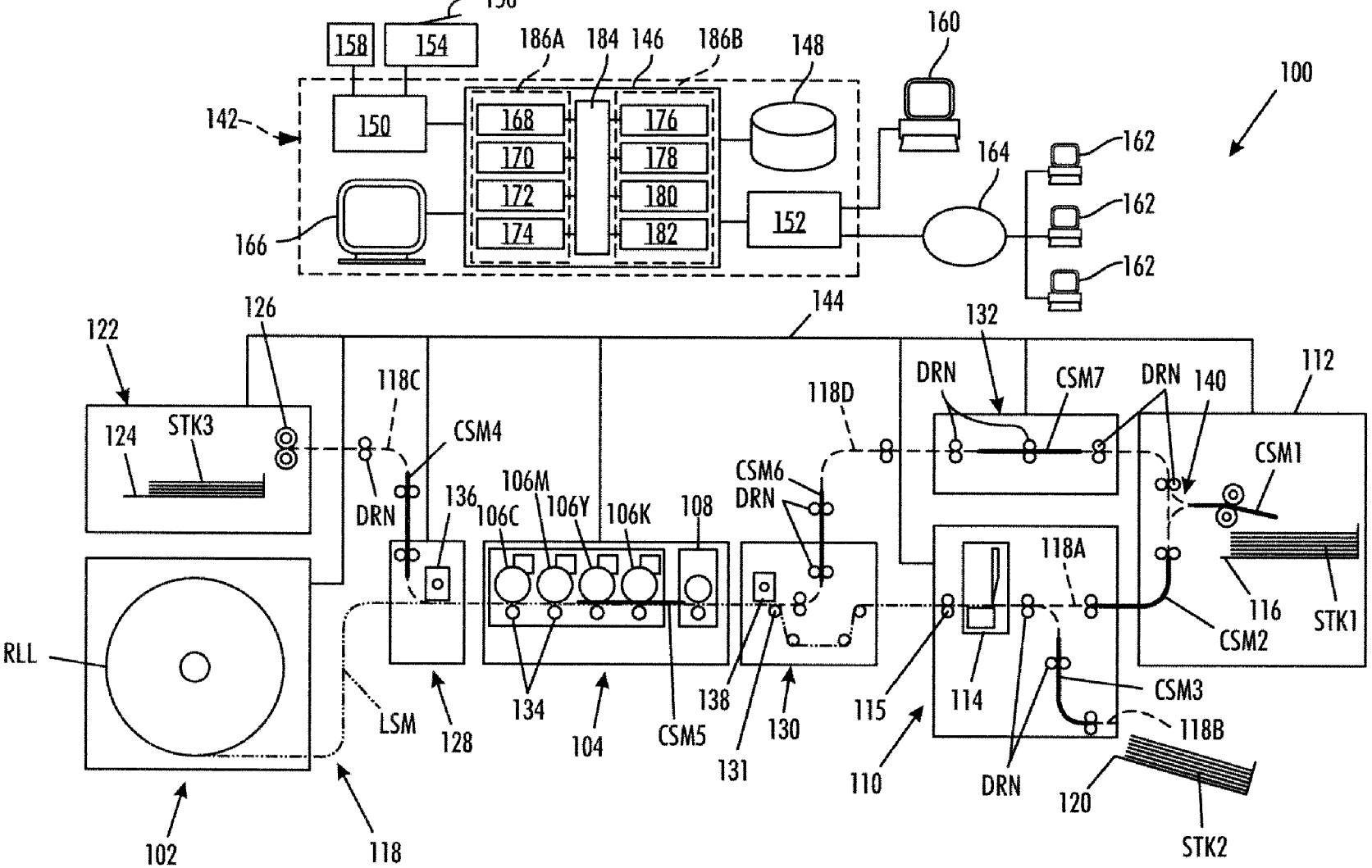
FIG. 1 is a schematic representation of one embodiment of a printing system capable of marking on continuous feed and pre-cut sheets of media.

Turning now to the drawings wherein the showings are for the purpose of illustrating exemplary embodiments, and not for limiting the same, FIG. 1 schematically illustrates a printing system 100 that includes a first sheet media source 102 operative to supply a substantially continuous length of sheet media LSM to the printing system. It will be appreciated that first sheet media source 102 can supply the length of sheet media to the printing system in any suitable form or manner, such as in the form of a roll RLL, for example. Additionally, it will be appreciated that the substantially continuous length of sheet media can be of any suitable length or other unit of measure, such as in the form of a roll of sheet material having a weight in a range from about 1,000 pounds to about 10,000 pounds, for example.

Printing system 100 also includes a marking unit 104, which may also be referred to herein as a printing unit, that is operatively disposed along length of sheet media LSM for marking text, images, graphics and/or any other indicia therealong. While it will be appreciated that the printing system can utilize any number of one or more image marking engines or other marking devices of any suitable type or kind, marking unit 104 is shown in FIG. 1 as including a plurality of electrophotographic marking systems, such as, for example, marking systems 106C, 106M, 106Y and 106K which correspond to a conventional CMYK color marking scheme. Of course, one or more other marking systems operating under the same or other color marking schemes could alternately, or additionally, be used. Additionally, marking unit 104 can optionally include a fuser 108 or other device suitable for fixing a marking substance of whatever type is used to the sheet media. In any case, it will be appreciated that the one or more printing engines can be of any suitable type or kind, and that such one or more printing engines will operate in accordance with known marking principles, such as ink jet marking or electrophotographic marking, for example.

Length of sheet media LSM extends through marking unit 104 to a cutting unit 110 or other suitable system or device for cutting, severing or otherwise separating the length of sheet media into individual cut sheets of media, which can then be collated, sorted and/or otherwise stacked, such as by a suitable finishing unit 112 or other sheet-receiving system or device. As shown in FIG. 1, cutting unit 110 is operatively disposed along length of sheet media LSM and includes a cutting system 114 that is operative to selectively cut, sever or otherwise separate the length of sheet media into individual cut sheets of media, such as are represented by cut sheets of media CSM1, CSM2 and CSM3 in FIG. 1, for example. Cutting unit 110 also includes one or more media conveying devices and/or elements, such as may be useful for pulling, urging, feeding or otherwise conveying the length of sheet media through or otherwise along the printing system. In the arrangement shown in FIG. 1, for example, a drive roll nip 115 is shown as being operatively disposed along length of sheet media LSM upstream of cutting system 114 for maintaining tension on the length of sheet media and/or otherwise urging the same through the cutting system.

Finishing unit 112 can include any suitable systems and/or components for receiving and stacking cut sheets of media. As shown in FIG. 1, finishing unit 112 includes a collection tray 116 adapted to receive and support a stack STK1 of cut sheets of media. It will be appreciated, however, that the finishing unit can be of any suitable type or kind, and can optionally be capable of performing one or more finishing operations of any type or kind. For example, the finishing unit can include any number of one or more collection trays for receiving sheets of media and can include any number of one or more compilers for at least approximately aligning the sheets of media within a collection tray. Additionally, the finishing unit could, optionally, be operative to perform sorting, collating, stapling, hole punching, offsetting, binding, folding, separator sheet inserting or any combination of these and/or any other finishing operations.

A media transport pathway, which is generally represented in FIG. 1 by reference number 118, extends from first sheet media source 102 to finishing unit 112 and is suitable for supporting and conveying length of sheet media LSM and any individual sheets of media formed therefrom along at least a portion of the of printing system 100. For clarity of illustration and ease of understanding, portions of media transport pathway 118 that are operatively associated with length of sheet media LSM, along with any media conveying devices and/or element that may be operatively associated with such portions of the media transport pathway are not shown in FIG. 1. However, once the length of sheet media is separated into individual sheets of media, a first portion 118A of the media transport pathway is shown as operatively connecting cutting unit 110 and finishing unit 112 and is suitable for transporting the individual sheets of media therebetween. A second portion 118B of the media transport pathway can optionally extend from cutting unit 110 to another sheet-receiving system and/or device, such as a collection tray 120, for example, that is adapted to receive and support a stack STK2 of cut sheets of media. Additionally, it will be appreciated that media conveying devices and/or elements of any suitable type, kind and/or quantity can be included along any one or more portions of media transport pathway 118. For example, numerous drive roll nips DRN are shown as being operatively disposed along first and second portions 118A and 118B of the media transport pathway.

Printing system 100 also includes at least one additional media source that is operative to store and selectively dispense or otherwise introduce pre-cut sheets of media into the transport pathway. In the exemplary arrangement shown in FIG. 1, a second sheet media source 122 includes a suitable supply tray 124 and one or more feeding elements, such as feeding system 126, for example, for sequentially outputting individual sheets of media from a stack STK3 or other bulk supply of pre-cut sheets of media. It will be appreciated, however, that any other suitable arrangement and/or configuration of components could alternately be used. Additionally, it will be appreciated that second sheet media source 122 is capable of storing and dispensing quantities of sheet media of any one of a variety of different sizes (e.g., letter, legal, A4) and/or orientations (e.g., short-edge first, long-edge first) as well as sheet media of different types, kinds, materials or combinations of material, weights and/or thicknesses.

Printing system 100 further includes a merging unit 128 and a separating unit 130 operatively disposed along length of sheet media LSM on opposing sides of marking unit 104. Thus, merging unit 128 is in operative communication between the marking unit and the first and second media sources. And, separating unit 130 is positioned in operative communication between the marking unit and cutting unit 110. Merging unit 128 is adapted to receive pre-cut sheets of media, as is represented by pre-cut sheet of media CSM4, from second media source 122, such as by way of a third portion 118C of the media transport pathway, for example, and position or otherwise place the pre-cut sheets of media in contact along length of sheet media LSM. In this way, the pre-cut sheets of media can be transported or otherwise moved through the marking unit (e.g., marking unit 104) together with and in a substantially fixed position relative to length of sheet media LSM, as is illustrated by pre-cut sheet of media CSM5 in FIG. 1. Again, media conveying devices and/or elements of any suitable type, kind and/or quantity can be included along any one or more portions of the media transport pathway, such as along third portion 118C thereof, for example.

Figure 2:
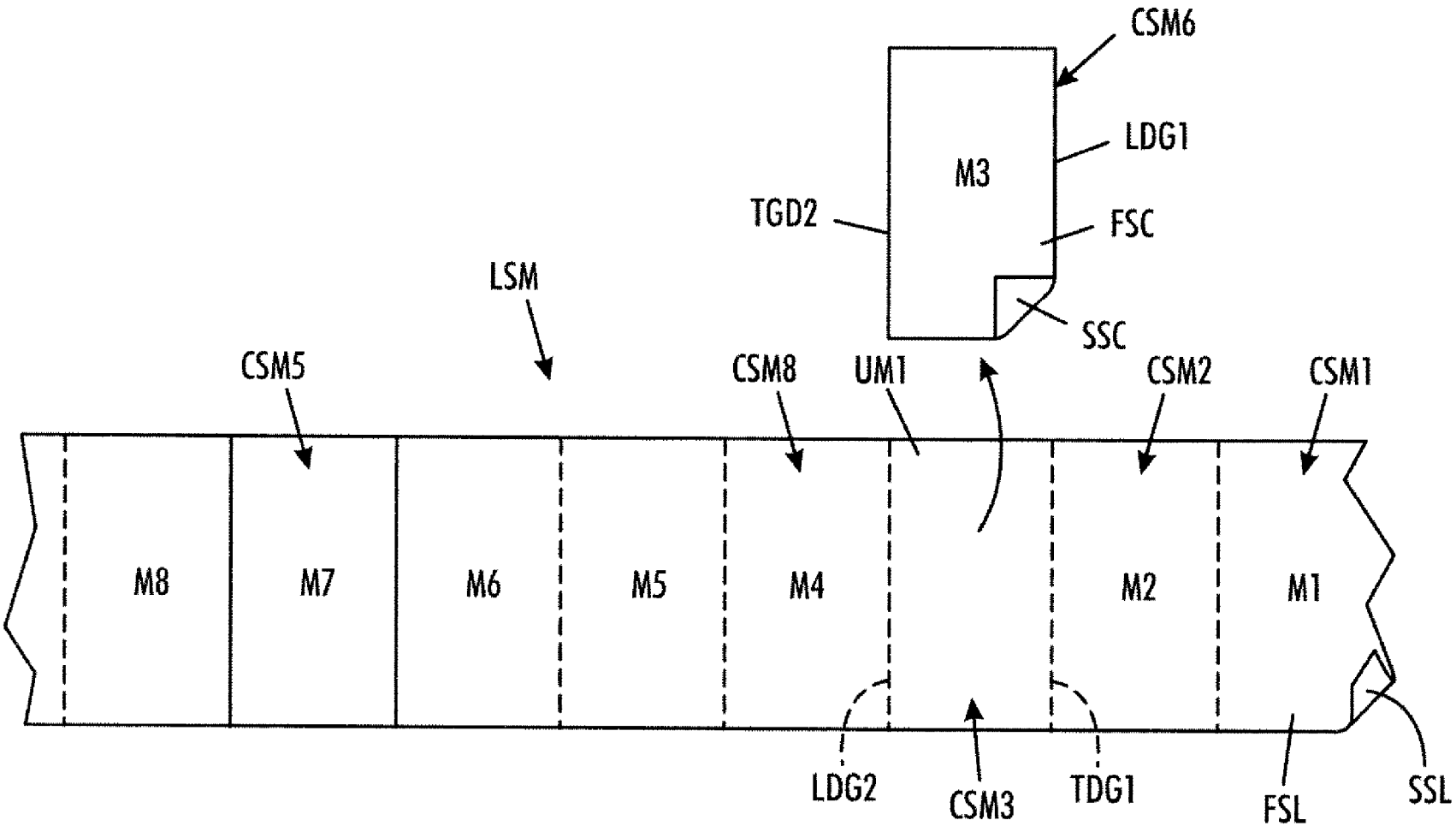
FIG. 2 is top plan view of a length of sheet media with marked and unmarked portions shown together with pre-cut sheets of marked media.

It will be recognized that length of sheet media LSM has opposing sides or surfaces extending longitudinally along the extended length thereof, such as first and second surfaces FSL and SSL of length of sheet media LSM in FIG. 2, for example, and that each of the pre-cut sheets of media will also have opposing sides or surfaces, such as first and second surfaces FSC and SSC of pre-cut sheet of media CSM6 in FIG. 2, for example. Thus, merging unit 128 is operative to introduce the pre-cut sheets of media and the length of sheet media to one another such that facings sides thereof are in abutting engagement with one another.

Oppositely, separating unit 130 is adapted to separate or otherwise remove the pre-cut sheets of media from along the length of sheet media, as is represented by pre-cut sheet of media CSM6 in FIGS. 1 and 2. As one example of a suitable arrangement, length of sheet media LSM can be directed around a relatively sharp bend (i.e., a curved path having a relatively small radius), such as may be formed by a roller element 131, for example, to aid in separating the pre-cut sheets of media from the length of sheet media. Upon separation from length of sheet media LSM, such as by separating unit 130, for example, the pre-cut sheets of media are directed toward finishing unit 112, such as by way of another portion 118D of the media transport pathway, for example. Printing system 100 can optionally include a buffering unit 132 or other suitable system and/or device for receiving and holding one or more pre-cut sheets of media (marked or unmarked), such as is represented by pre-cut sheet of media CSM7 in FIG. 1, for example. Once again, it will be appreciated that media conveying devices and/or elements of any suitable type, kind and/or quantity can be included along any one or more portions of the media transport pathway, such as along third portion 118D thereof, for example.

Turning, now, to the general operation of a printing system in accordance with the present disclosure, such as printing system 100, for example, an elongated length of sheet media, such as length of sheet media LSM, for example, extends from a sheet media source (e.g., first sheet media source 102) operatively along one or more image marking engines (e.g., marking systems 106C, 106M, 106Y and 106K of marking unit 104). The one or more image marking engines are operative to mark images (e.g., text characters, symbols, graphical representations and other indicia of any kind) along at least one surface of the length of sheet material as the length of sheet material travels through or is otherwise moved in operative association along the one or more image marking engines.

It will be appreciated that the length of sheet media (e.g., length of sheet media LSM) travels or is otherwise fed through the printing system (e.g., printing system 100) in a substantially continuous manner so that successive images are generated along the extended (i.e., longitudinal) length of the length of sheet media. As one example, length of sheet media LSM is shown in FIG. 2 as including a plurality of images, which are represented by reference characters M1, M2, M4, M5, M6 and M8, formed along first surface FSL thereof. Reference characters M1, M2, M4, M5, M6 and M8 can, in one exemplary case, correspond to individual pages of the particular document being printed by the printing system. In such case, the document may call for these pages to be printed on sheet media having properties and/or characteristics that are at least approximately the same as those of the length of sheet media being conveyed into and through the printing system.

As shown in FIG. 1, for example, the length of sheet media continues to travel from the one or more image marking engines toward a suitable system or device (e.g., cutting unit 110) for cutting or otherwise separating the length of sheet media into individual sheets of media (e.g., cut sheets of media CSM1, CSM2 and CSM3). The individual sheets of media can then be delivered by way of one or more portions (e.g., portions 118A and 118B) of a media transport pathway to a sheet-receiving unit or system (e.g., finishing unit 112 and collection tray 120) that is adapted to suitably collect the individual sheets of media and, optionally, perform one or more finishing operations thereon.

As discussed previously, a particular document or print job may call for one or more pages thereof to be printed on sheet media having properties and/or characteristics that are different than those of other pages of the document, which may be printed from length of sheet media LSM, for example. One manner of addressing such a situation is to utilize a printing system in accordance with the present disclosure, such as printing system 100, for example, that includes one or more additional sheet media sources (e.g., second sheet media source 122) that are adapted to dispense individual pre-cut sheets of media (e.g., pre-cut sheet of media CSM4), such as from a stack STK3 of pre-cut sheets of media, for example. In such case, pre-cut sheets of media having different properties and/or characteristic than those of the length of sheet media can be provided. The individual pre-cut sheets of media (e.g., pre-cut sheet of media CSM4) are directed toward the length of sheet material, such as along a portion (e.g., portion 118C) of a media transport pathway.

The pre-cut sheets of media are then selectively introduced into abutting engagement along the length of sheet media by a suitable system or device (e.g., merging unit 128). Said differently, a suitable merging unit is operative to selectively position or otherwise place pre-cut sheets of media on or along the length of sheet media. It will be appreciated that the pre-cut sheets of media, which will have the properties and/or characteristics called for by the corresponding pages or sheets of the particular document or print job being produced, will benefit from being placed in predetermined positions on or along the length of sheet media. For example, pre-cut sheet of media CSM6 could be positioned along length of sheet media LSM such that a leading edge LDG1 thereof is positioned at or along an area that will become a trailing edge TDG1 of cut sheet of media CSM2, as shown in FIG. 2. In turn, a trailing edge TDG2 of pre-cut sheet of media CSM6 will reside in or at least partially define an approximate area that will become a leading edge LDG2 of the next cut sheet of media (e.g., a cut sheet of media CSM8).

The pre-cut sheets of media (e.g., pre-cut sheet of media CSM5) can be retained in place on or along the length of sheet media in any suitable manner, such as by using transfer nips 134, for example. It will be appreciated, however, that any other suitable technique, device, arrangement or combination thereof can alternately, or additionally, be used to maintain the pre-cut sheets of media in a substantially fixed position on or along the length of sheet media. For example, merging unit 128 is shown in FIG. 1 as, optionally, including an electrostatic tacking device 136 suitable for generating an electrostatic bond between the pre-cut sheet of media and the length of sheet material.

Once the pre-cut sheet of media is positioned on or along the length of sheet media, the pre-cut sheet or media and the length of sheet media, together, travel through or otherwise operatively along the one or more image marking engines such that images (e.g., images M1, M2, M4, M5, M6 and M8) can be printed on individual portions of the length of sheet media as well as on the pre-cut sheets of media, as is respectively indicated by reference characters M3 and M7 on pre-cut sheets of media CSM6 and CSM5 in FIG. 2. Thus, length of sheet media LSM will result in having one or more marked portions, which are represented by the sheet sections having images M1, M2, M4, M5, M6 and M8 in FIG. 2, and one or more unmarked portions UM1, which are shown as being disposed beneath or otherwise covered by pre-cut sheets of media CSM5 and CSM6. In the exemplary case shown, unmarked portion UM1 could become and, as such, is represented by cut sheet of media CSM3.

Having traveled beyond the one or more image marking engines as well as any device or component (e.g., fuser 108) for fixing the marking substance (e.g., toner, ink or other colorant) thereon, the pre-cut sheets of media can then be separated or otherwise removed from contact with the length of sheet media, such as is represented by pre-cut sheet of media CSM6 in FIGS. 1 and 2, for example. As one example, such a separating operation could be performed by simply directing the pre-cut sheets of media along a different portion (e.g., portion 118D) of the media transport pathway. Optionally, one or more other devices could be used to detach or otherwise unsecure the pre-cut sheets of media from the length of sheet media. For example, separating unit 130 is shown in FIG. 1 as, optionally, including an electrostatic detacking device 138 suitable for dissipating an electrostatic bond between the pre-cut sheet of media and the length of sheet material.

As discussed above, in one exemplary case, the length of sheet media and any one or more pre-cut sheets of media positioned thereon may be marked in a sequence or predetermined order of printing, such as from the first to last page of a document, for example. In such case, most of the pages of the document may be printed in order on the length of sheet media with a few intervening pages printed on pre-cut sheets of media having different properties and/or characteristics than those of the length of sheet media. To assist in maintaining the sheets of media in the desired sequence or predetermined order, a sheet storage device or temporary holding unit (e.g., buffering unit 132) can be operatively disposed between the separating device (e.g., separating unit 130) and the sheet-receiving system or device (e.g., finishing unit 112). The sheet storage device is adapted to temporarily store or otherwise hold one or more pre-cut sheets of media, which will typically have images marked thereon, for later delivery to the sheet-receiving system or device at a suitable time for maintaining the sequence or predetermined order of printing.

Once the pre-cut sheets of media are separated therefrom, the length of sheet material continues traveling to a suitable system or device (e.g., cutting system 114 of cutting unit 110) for cutting, severing or otherwise separating the length of sheet media (e.g., length of sheet media LSM) into individual sheets of media (e.g., cut sheets of media CSM1, CSM2 and CSM3), at least some of which are marked with images and represent pages of the particular document being printed (e.g., cut sheets of media CSM1 and CSM2). These individual sheets of media, which may have images marked thereon or otherwise represent pages of the particular document being printed, can then be transported or otherwise delivered to the sheet-receiving system or device (e.g., finishing unit 112). It will be appreciated that these sheets of media will largely remain in the same order or sequence of printing and, thus, can simply be stacked or otherwise compiled by the sheet-receiving system or device. However, any pre-cut sheets of media (e.g., pre-cut sheet of media CSM7) that may be being stored or otherwise held, such as in buffering unit 132, for example, for later recombination with the other pages of the document can be selectively reintroduced into the flow of sheets of media into the sheet-receiving system or device, such as by using a merging unit 140 or other suitable device or arrangement, for example, that is operatively associated with the sheet-receiving system (e.g., finishing unit 112).

It will be recognized, however, that certain ones of the individual sheets of media (e.g., cut sheet of media CSM3), which were generated by cutting the length of sheet media into individual sheets of media, will be unmarked portions of the length of sheet media that do not form a part of the particular document being printed. Rather, these individual sheets of media (e.g., cut sheet of media CSM3) represent portions of the length of sheet media that supported (i.e., that were disposed beneath) the pre-cut sheets of media during one or more marking operations. As such, these individual sheets of unmarked media are not stacked or otherwise compiled with the pages of the document being printed, such as at finishing unit 112, for example. Rather, these individual sheets of unmarked media can be directed to a second or otherwise different sheet-receiving system or device (e.g., collection tray 120), such as for recycling or later use in another printing operation, for example.

Printing system 100 also includes a control system 142 that is in communication with one or more of the units, systems and/or devices of the printing system for selective operation and/or control thereof. In the embodiment shown in FIG. 1, control system 142 is shown as being in communication with each of these systems, such as by way of communication lines 144, for example. It is to be distinctly understood, however, that one or more aspects of the present disclosure are applicable to a wide variety of types and kinds of printing systems, and that control system 142 is merely exemplary of one suitable control system for one such printing system.

A suitable control system, such as control system 142, for example, can be utilized to operate the foregoing and other units, systems and/or components of the printing system, such as in the manner of operation discussed hereinbefore, for example. As shown in FIG. 1, control system 142 includes a controller 146 in communication with first sheet media source 102, marking unit 104, cutting unit 110, finishing unit 112, second media source 122, merging unit 128, separating unit 130 and buffering unit 132, each in a suitable manner. As one example, one or more of these systems and/or units could be under direct supervision and control by controller 146, as is illustrated in FIG. 1. Alternately, control system 142 could optionally include one or more electronic control units (ECUs) that are respectively associated with a one or more of these systems and/o units. Such one or more ECUs, if provided, could be in communication with the controller and at least partially supervise and/or control the respective systems and/or units with which the ECU or ECUs are associated.

Control system 142 can optionally include a data storage device 148, such as a non-volatile memory or hard drive, for example, that is suitable for storing print jobs, settings, attributes and any other data, values, text, graphics, information and/or content. The data storage device is shown in FIG. 1 as being in direct communication with controller 146, though it will be appreciated that any other suitable arrangement could alternately be used. Additionally, control system 142 can optionally include an input interface 150 and/or a communication interface 152, both of which are shown as being in communication with controller 146.

Either or both of input interface 150 and communication interface 152 can be used to communicate, generate, receive, input or otherwise provide print jobs (e.g., inputted documents) to the printing system. For example, input interface 150 can be in communication with an optional raster output scanning system 154 suitable for scanning paper documents and transmitting rasterized images of the scanned documents in the form of image data to the controller or another system or component. Scanning system 154 can optionally include an automatic document feeding device 156 or other suitable arrangement for inputting sheet media. As another example, input interface 150 could be in communication with an optional memory device reader 158 adapted to retrieve document files, image files or other data or information from portable memory devices, such as memory cards, for example, and transmit such files, data or information to controller 146 or another system or component.

As a further example, a print job could optionally be transferred or otherwise sent to the printing system through communication interface 152, such as from a standalone computer 160 and/or from a computer workstation or terminal 162, for example, by way of any suitable line of communication, such as through a computer network 164, for example. A print job, however transmitted or received, can be directly communicated to controller 146 for processing or the print job can be stored in a suitable manner, such as within data storage device 148, for example, until recalled for printing.

One or more user interface devices, such as a display, keyboard, pointing device, indicator lamp, associated computing device (e.g., a remotely connected or networked computer) or other input or output device, for example, is provided on printing system 100 and is in communication with controller 146. In one preferred embodiment, a display 166 is provided that outputs graphical programming windows for communication of text, graphics, data, values and/or information to a user or operator. Additionally, the user interface is adapted for user input of text, graphics, data, values and/or information, such as from the keyboard (not shown), pointing device (not shown) or, in one preferred embodiment, touch-screen input on display 166, for example. It will be appreciated, however, that the foregoing user interface arrangement is merely exemplary and that text, graphics, data, values and/or information can be inputted and outputted in any suitable manner.

Control system 142, as is shown in FIG. 1, can optionally include a print job-receiving module 168 that is capable of receiving, processing, storing and/or otherwise transferring data, information, signals and/or communications relating to a print job communicated to printing system 100, such as by way of input interface 150 and/or communication interface 152, for example. As one example, a print job could be received by way of communication interface 152 and include image data, which is represented in FIG. 1 by box 170, representing or otherwise having a relation to the markings to be generated on one or more of sheets of media. Such a print job may also include sheet media data, which is represented in FIG. 1 by box 172, representing or otherwise having a relation to print job characteristics, such as the size and type of sheet media to be used for the different pages of the print job, the number of reproductions of the document to be generated and/or the desired finishing operations to be performed, for example. Print job-receiving module 168 is preferably capable of receiving, processing, storing and/or communicating such image and sheet media data to one or more other systems and/or components of printing system 100.

As previously discussed, a control system, such as control system 142, for example, is operative to selectively control the feed rate of a length of sheet media (e.g., length of sheet media LSM) traveling through or otherwise along a printing system (e.g., printing system 100). Additionally, the control system is operative to selectively dispense pre-cut sheets of media (e.g., cut sheet of media CSM4) into the printing system. It will be appreciated that such control of the feed rate and dispensing of pre-cut sheets of media can be effected or otherwise implemented in any suitable manner. For example, control system 142 is shown in FIG. 1 as including a sheet media control module 174 that is capable of sending, receiving, generating and/or otherwise communicating data, information, signals and/or instructions having a relation to the feeding (e.g., start, stop and/or feed rate) of a length of sheet media into the printing system. Additionally, sheet media control module 174 can be capable of sending, receiving, generating and/or otherwise communicating data, information, signals and/or instructions having a relation to the dispensing of pre-cut sheets of media into printing system. For example, sheet media control module 174 could utilize sheet media data, as is represented by box 172, for example, to selectively dispense pre-cut sheets of media of an appropriate size, type, thickness and/or material as called for by the particular document being produced.

A control system, such as control system 142, for example, is also operative to selectively control the introduction of pre-cut sheets of media (e.g., cut sheet of media CSM4) onto or otherwise along the length of sheet media as well as selectively control the separation of such pre-cut sheets of media from the length of sheet media. It will be appreciated that such selective introduction and separation of pre-cut sheets of media can be can be effected or otherwise implemented in any suitable manner. For example, control system 142 is shown in FIG. 1 as including a merging and separating module 176 that is capable of sending, receiving, generating and/or otherwise communicating data, information, signals and/or instructions having a relation to introduction and separation of the pre-cut sheets of media into the portion of the media transport conveying the length of sheet media. It will be appreciated that merging and separating module 176 can utilize any suitable data, signals and/or other information, such as timing signals and/or sheet-arrival sensor signals, for example, in controlling such merging and separation of the pre-cut sheets of media.

Additionally, a control system, such as control system 142, for example, can also be adapted to selectively control the operation of one or more image marking engines (e.g., marking systems 106C, 106M, 106Y and 106K of marking unit 104) for printing images on the length of sheet media and the pre-cut sheets of media as the same are together operatively conveyed through or otherwise operatively along the one or more image marking engines. It will be appreciated that such selective control and operation can be effected or otherwise implemented in any suitable manner. For example, control system 142 is shown in FIG. 1 as including a marking module 178 that is capable of sending, receiving, generating and/or otherwise communicating data, information, signals and/or instructions having a relation to the printing of images on corresponding portions of the length of sheet media or pre-cut sheets of media, such as in a predetermined sequence or order, for example. As one example, marking module 178 could utilize image data, as is represented by box 170, for example, to selectively control the generation of images by the one or more marking engines. Additionally, marking module 178 could selectively control any adjustments to the one or more image marking engines to accommodate changes is printing conditions, such as thickness or height change due to the arrival of a pre-cut sheet of media at an image marking engine, for example.

Furthermore, a control system, such as control system 142, for example, can be adapted to selectively control the cutting or separation of the length of sheet media into individual sheets of media (e.g., cut sheets of media CSM1, CSM2 and CSM3) and, optionally, the distribution of selected ones of these individual sheets of media to one or more sheet-receiving systems and/or devices (e.g., finishing unit 112 and collection tray 120). It will be appreciated that such selective control of cutting and distributing operations can be effected or otherwise implemented in any suitable manner. For example, control system 142 is shown in FIG. 1 as including a cutting and distribution module 180 that is capable of sending, receiving, generating and/or otherwise communicating data, information, signals and/or instructions having a relation to the cutting of the length of sheet media into individual sheets of media as well as the sorting or selective distribution of the individual sheets of media to one or more sheet-receiving systems or devices. It will be appreciated that cutting and distribution module 180 can utilize any suitable data, signals and/or other information, such as timing signals and/or sheet-arrival sensor signals, for example, in controlling cutting of the length of sheet media and selective sorting or distribution of the individual sheets of media resulting therefrom.

A control system, such as control system 142, for example, is also operative to selectively operate one or more merging and/or sheet-receiving systems (e.g., merging unit 140 and finishing unit 112) for generating one or more stacks of cut sheets of media with the individual sheets thereof in a predetermined sequence or order, such as may be defined by a particular document being printed, for example. It will be appreciated that such selective operation of merging and/or sheet-receiving systems can be effected or otherwise implemented in any suitable manner. For example, control system 142 is shown in FIG. 1 as including a compiling module 182 that is capable of sending, receiving, generating and/or otherwise communicating data, information, signals and/or instructions having a relation to the selective distribution, merging and/or compiling of cut sheets of media into the pages of a particular document. As one example of such operation, the compiling module could be operative to selectively control interleaving of pre-cut sheets of media (e.g., pre-cut sheet of media CSM7) into a stream of individual sheets of media (e.g., cut sheets of media CSM1 and CSM2) formed from the length of sheet media.

A control system, such as control system 142, for example, will include a processing device, which can be of any suitable type, kind and/or configuration, such as a microprocessor, for example, for processing data, executing software routines/programs, and other functions relating to the performance and/or operation of the printing system (e.g., printing system 100). Additionally, the control system (e.g., control system 142) will include a storage device or memory, which can be of any suitable type, kind and/or configuration that can be used to store data, values, settings, parameters, inputs, software, algorithms, routines, programs and/or other information or content for any associated use or function, such as use in association with the performance and/or operation of the printing system or communication with a user or operator, for example.

In the embodiment shown in FIG. 1, controller 146 includes a microprocessor 184 and a storage device or memory, which is represented in FIG. 1 by boxes 186A and 186B. In the embodiment shown, modules 168, 174, 176, 178, 180 and 182 are implemented as software stored within memory 186A and 186B. Thus, microprocessor 184 can access memory stores 186A and 186B to retrieve and execute any one or more software modules, such as modules 168, 174, 176, 178, 180 and 182, for example. Additionally, data, values, settings, parameters, inputs, software, algorithms, routines, programs and/or other information or content, such as data 170 and 172, for example, can also be retained within memory 186A and 186B for retrieval by microprocessor 184. It will be appreciated that such software routines can be individually executable routines or portions of a software program, such as an operating system, for example. Additionally, it will be appreciated that the control system, including any controller, processing device and/or memory, can take any suitable form, configuration and/or arrangement, and that the embodiments shown and described herein are merely exemplary. Furthermore, it is to be understood, however, that the modules described above in detail can be implemented in any suitable manner, including, without limitation, software implementations, hardware implementations or any combination thereof.

Figure 3:
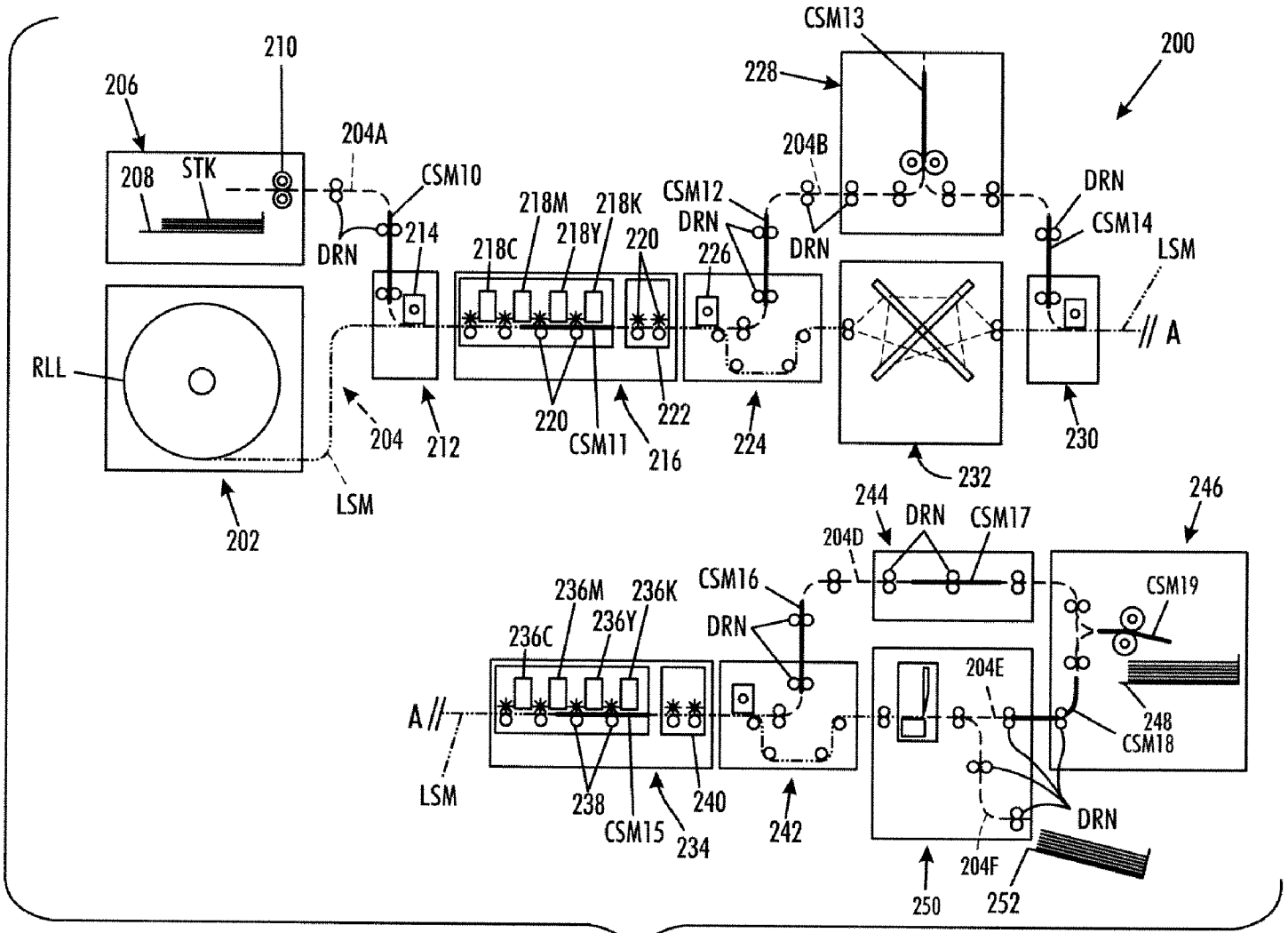
FIG. 3 is a schematic representation of another embodiment of a printing system capable of duplex marking on continuous feed and cut sheet media.

FIG. 3 illustrates another example of a printing system 200 that is adapted to mark images on or along a length of sheet media together with pre-cut sheets of media in accordance with the subject matter of the present disclosure. It will be appreciated that printing system 200 includes many of the same units, systems and/or devices and operates according to many of the same principles of operation as have been described above with regard to printing system 100. As such, these common units, systems, devices and/or principles of operation will only be briefly described with regard to printing system 200. Additionally, it will be appreciated that a control system (not shown), such as control system 142, for example, would be operatively associated with printing system 200 for selective operation and control thereof. However, printing system 200 differs from printing system 100 in that printing system 200 is adapted for duplex printing of the length of sheet media and pre-cut sheets of media.

As shown in FIG. 3, printing system 200 includes a first sheet media source 202 that is adapted to dispense a length of sheet media LSM, such as from a roll RLL, for example, to the printing system, such as along a media transport pathway, which is generally indicated by reference number 204, and can include media conveying devices and/or elements of any suitable type, kind and/or quantity operatively disposed along any one or more portions of the media transport pathway, such as are indicated by drive roll nips DRN, for example. A second sheet media source 206 is adapted to selectively dispense pre-cut sheets of media, such as may be supplied from a stack STK residing in a supply tray 208, for example, using a suitable sheet-feeding system or device 210 to a portion 204A of the media transport pathway, as is indicated by pre-cut sheet or media CSM10. The pre-cut sheets of media are received by a first merging unit 212 or other device for selectively introducing the pre-cut sheets of media into abutting engagement with the length of sheet media. Optionally, the first merging unit can include an electrostatic tacking device 214 or other suitable system or element for at least partially securing the pre-cut sheets of media in a substantially fixed position along the length of sheet media.

Printing system 200 also includes a first marking unit 216 that is disposed in operative association along length of sheet media LSM. First marking unit 216 can include any suitable number of one or more image marking engines, such as marking systems 218C, 218M, 218Y and 218K, for example. Additionally, it will be appreciated that a pre-cut sheet of media, such as pre-cut sheet of media CSM11, for example, can be maintained in a substantially fixed position along length of sheet media LSM using star wheel and roller assemblies 220 alone or in combination with any other suitable arrangements, such as electrostatic tacking, for example. First marking unit 216 can also optionally include a suitable system or device for fixing the marking substance on the length of sheet media and the pre-cut sheets of media. In the exemplary arrangement shown in FIG. 3, first marking unit 216 operates on ink jet marking principles and can include an optional drying or curing unit 222 operatively disposed along the media transport pathway. It will be appreciated, however, that any other suitable type or kind of marking operation could alternately, or additionally, be uses, such as xerographic marking, for example.

Printing system 200 is shown as also including a first separating unit 224 or other device for separating the pre-cut sheets of media (e.g., pre-cut sheet of media CSM12) from the length of sheet media. First separating unit 224 can optionally include an electrostatic detacking unit 226 or other suitable system or element for dissipating any electrostatic bond between the length of sheet media and the pre-cut sheets of media. First separating unit 224 is also operatively associated with a portion 204B of the media transport pathway that is operative to convey the pre-cut sheets of media to a suitable sheet inverting system or device, such as inverting unit 228, for example, for changing the orientation of the pre-cut sheets of media (e.g., pre-cut sheet of media CSM13) such that the opposing surfaces or sides thereof are disposed in opposite direction (e.g., top and bottom) as the pre-cut sheets of media are directed further downstream, such as along a portion 204C of the media transport pathway toward a second merging unit 230, for example. In this manner, any images marked on the pre-cut sheets of media will be disposed along the bottom surface thereof and the unmarked, top surface thereof will be exposed for further marking operations.

Printing system 200 is shown in FIG. 3 as also including a suitable system or device for inverting length of sheet media LSM so that the opposing surfaces or sides thereof are facing on opposing directions (e.g., top and bottom) as the length of sheet is conveyed further downstream along the media transport pathway. It will be appreciated that such an inversion of the length of sheet media can be accomplished in any suitable manner, such as by utilizing a turn bar 232 or other suitable system or device, for example. In one exemplary configuration, length of sheet media LSM will exit the turn bar with the opposing surface thereof facing upward, such that the images marked thereon are disposed along the bottom of the length of sheet media. In this manner, the unmarked, top surface thereof will be exposed for further marking operations. As such, the now-inverted length of sheet media and a now-inverted pre-cut sheet of media, such as pre-cut sheet of media CSM14, for example, can be merged or otherwise re-introduced to one another such that further marking operations (i.e., a duplex marking operation) can be performed thereon.

The now inverted and re-merged length of sheet media and pre-cut sheets of media can be further conveyed downstream along the media transport pathway toward a second marking unit 234. As shown in FIG. 3, the second marking unit is substantially similar to first marking unit 216, and can also include any suitable number of one or more image marking engines, such as marking systems 236C, 236M, 236Y and 236K, for example. While marking systems 236C, 236M, 236Y and 236K are shown in FIG. 3 as operating on ink jet marking principles, it will be appreciated that any other suitable principles of operation could alternately be use, such as xerographic marking, for example.

Again, it will be appreciated that a pre-cut sheet of media, such as pre-cut sheet of media CSM15, for example, can be maintained in a substantially fixed position along length of sheet media LSM using star wheel and roller assemblies 238 alone or in combination with any other suitable arrangements, such as electrostatic tacking, for example. Also, a suitable drying or curing unit 240 can, optionally, be operatively disposed along the media transport pathway, as discussed above. Upon exiting second marking unit 234, the length of sheet media and pre-cut sheets of media, each of which may now be marked on or along both surfaces thereof, reach a second separating unit 242 at which the pre-cut sheets of media are separated from the length of sheet media and can be directed along a portion 204D of the media transport pathway, as is indicated by pre-cut sheet of media CSM16, for example.

Once separated from the length of sheet media, the pre-cut sheets of media (e.g., pre-cut sheet of media CSM17) may be temporarily held or otherwise maintained in a suitable system or device, such as a buffering unit 244, for example, prior to delivery to a downstream sheet-receiving system or device, such as a finishing unit 246 having a collection tray 248, for example. Additionally, length of sheet media LSM is conveyed downstream toward a suitable system or device, such as cutting unit 250, for example, for cutting, severing or otherwise separating the length of sheet media into individual sheets of media, such as is indicated by sheets of media CSM18 and CSM19. Thereafter, the individual sheets of media can be conveyed from the cutting unit toward a suitable sheet-receiving system or device, such as finishing unit 246 by way of a portion 204E of the media transport pathway or a collection tray 252 by way of a portion 204F of the media transport pathway.

In one preferred arrangement, printing system 200 will take the form of a single, continuous printing system that includes second merging unit 230 and second marking unit 232 disposed adjacent one another. In this preferred arrangement, the length of sheet media together with any pre-cut sheets of media can be conveyed or otherwise transported directly from the second merging unit into the second marking unit, as is represented by coincident points A in FIG. 3. It will be appreciated, however, that any other suitable arrangement and/or configuration could alternately be used.

Figure 4:
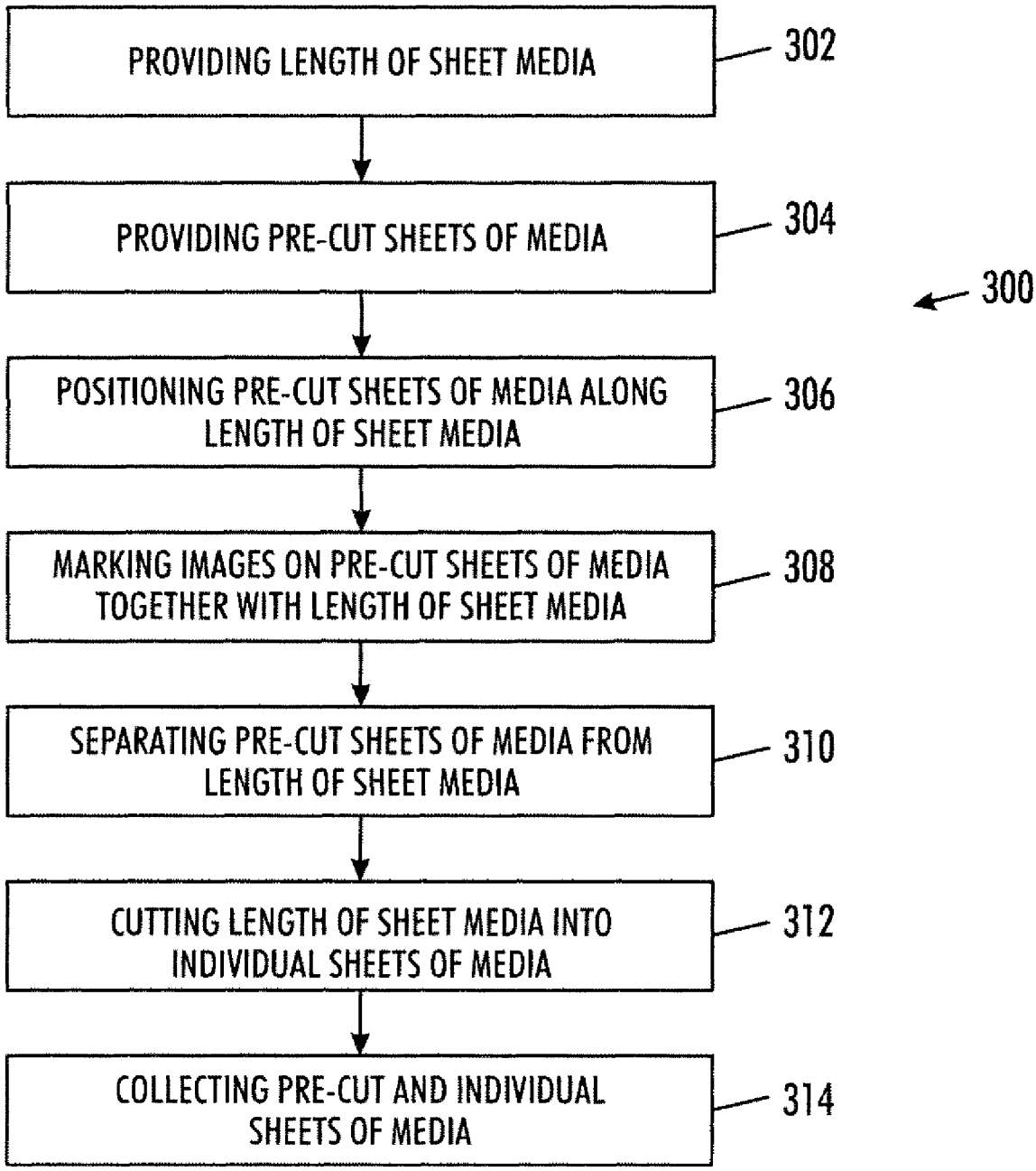
FIG. 4 is a graphical representation of one exemplary method of marking on continuous feed and cut sheet media.

FIG. 4 illustrates one exemplary method 300 of printing a multi-sheet document in accordance with the subject matter of the present disclosure. Method 300 includes an action of providing a length of sheet media, such as length of sheet media LSM in FIGS. 1-3, for example, as is indicated by box 302 in FIG. 4. Method 300 also includes an action of providing a quantity of pre-cut sheets of media, such as are supplied by second sheet media sources 122 and 206 in FIGS. 1 and 3, respectively, as is indicated by box 304 in FIG. 4. Method 300 further includes an action of merging or otherwise positioning the pre-cut sheets of media on or along the length of sheet media, such as by using one of merging units 128, 212 and/or 230, for example, as is indicated by box 306 in FIG. 4.

Method 300 also includes an action of marking images (e.g., images M1-M8 in FIG. 2) on a surface of the pre-cut sheets of media as well as on portions of the length of sheet media, as is indicated by box 308 in FIG. 4. Method 300 further includes separating the pre-cut sheets of media from the length of sheet media, such as by using one of separating units 130, 224 and/or 242, for example, as is indicated by box 310. Method 300 is also shown as including an action of cutting or otherwise separating the length of sheet media into individual sheets of media (e.g., CSM1-CSM3 in FIG. 1), as is indicated by box 312 in FIG. 4. Method 300 further includes an action of collecting the pre-cut sheets of media and the individual sheets of media generated from the length of sheet media, such as by using one of finishing units 112 and 246, for example, as indicated by box 314 in FIG. 4. It will be appreciated that the foregoing discussion of method 300 is merely exemplary and that any additional steps, actions or activities can additionally, or alternately, be included, without limitation.

It will be appreciated that any one or more of the above-disclosed and other features and/or functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing system comprising:

a first media source supplying a longitudinally-extending length of sheet media having opposing first and second surfaces;

a second media source supplying pre-cut sheets of media;

a merging unit operatively disposed along said length of sheet media, said merging unit adapted to receive said pre-cut sheets of media from said second media source and operative to position said pre-cut sheets of media in longitudinally-spaced relation to one another along said first side of said length of sheet media;

a marking unit operatively disposed along said length of sheet media and adapted to mark images on said pre-cut sheets of media as well said length of sheet media thereby generating pre-cut sheets of marked media as well as marked and unmarked portions of said length of sheet media with said unmarked portions extending beneath said pre-cut sheets of marked media;

a separating unit operatively disposed along said length of sheet media, said separating unit adapted to separate said pre-cut sheets of marked media from said length of sheet media and thereby expose said unmarked portions of said length of sheet media;

a cutting unit operatively disposed along said length of sheet media and operative to sever said length of sheet media into individual sheets of media such that marked sheets of media are formed from said marked portions of said length of sheet media and unmarked sheets of media are formed from said unmarked portions of said length of sheet media; and, a sheet collection unit adapted to receive at least said marked sheets of media from said cutting unit and said pre-cut sheets of marked media from said separating unit.

2. A printing system according to claim at 1, wherein said sheet collection unit is a first sheet collection unit, and said printing system further comprises a second collection unit adapted to receive said unmarked sheets of media from said cutting unit.

3. A printing system according to claim 1, wherein said sheet collection unit includes a media transport pathway and a collection tray, said media transport pathway including first and second pathway inlets and a pathway outlet, said first pathway inlet being operatively connected to said cutting unit, said second pathway inlet being operatively connected to said separating unit, and said pathway outlet being disposed in operative communication with said collection tray such that said marked sheets of media from said cutting unit and said pre-cut sheets of marked media from said separating unit can be sequentially output to said collection tray.

4. A printing system according to claim 3 further comprising a sheet buffer operatively disposed between said separating unit and said sheet collection unit, said sheet buffer being adapted to receive said pre-cut sheets of marked media from said separating unit and retain said pre-cut sheets of marked media prior to releasing said the pre-cut sheets of marked media to said sheet collection unit for interleaving with said marked sheets of media from said cutting unit.

5. A printing system according to claim 1, wherein said marking unit is one of an ink jet marking unit and a xerographic marking unit.

6. A printing system according to claim 1, wherein said marking unit is a first marking unit and said printing system further comprises a second marking unit operatively disposed along said length of sheet media and adapted to mark images along at least said second side of said length of sheet media.

7. A printing system according to claim 6 further comprising a first media inverting unit operatively associated with said length of sheet media and adapted to invert said first and second sides thereof.

8. A printing system according to claim 7 further comprising a second media inverting unit in operative communication with said separating unit and adapted to invert first and second sides of said pre-cut sheets of media.

9. A printing system according to claim 8, wherein said merging unit is a first merging unit, and said printing system further comprises a second merging unit operatively disposed along said length of sheet media, said second merging unit receiving said inverted pre-cut sheets of media from said second media inverting unit and said second merging unit adapted to position said inverted pre-cut sheets of media along said second side of said length of sheet media such that said second marking unit is capable of marking images along said inverted pre-cut sheets of media and along said second side of said length of sheet media.

10. A printing system according to claim 9, wherein said separating unit is a first separating unit, and said printing system further comprises a second separating unit operatively disposed along said length of sheet media, said second separating unit adapted to separate said inverted pre-cut sheets of marked media from said second side of said length of sheet media.

11. A printing system comprising:

a continuous sheet media source operative to dispense a length of sheet media;

a cut sheet media source adapted to dispense pre-cut sheets of media;

a marking unit adapted to generate marked images on said length of sheet media and said pre-cut sheets of media;

a sheet media collection unit adapted to receive cut sheets of media; and, a transport pathway operatively connecting said continuous sheet media source, said sheet media collection unit, said marking unit and said cut sheet media source, said transport pathway including:

a merge portion operatively disposed between said continuous sheet media source and said marking unit, said merge portion adapted to receive and selectively position pre-cut sheets of media along said length of sheet media such that said pre-cut sheets of media can be conveyed in operative association along said marking unit together with said length of sheet media; and, a separator portion operatively disposed between said marking unit and said sheet media collection unit, said separator portion adapted to separate said pre-cut sheets of media from said length of sheet media.

12. A printing system according to claim 11 further comprising a cutting unit operatively disposed between said marking unit and said sheet media collection unit, said cutting unit adapted to separate said length of sheet media into cut sheets of media.

13. A printing system according to claim 11, wherein said marking unit includes at least one of an ink jet image marking engine and an electrophotographic image marking engine.

14. A printing system according to claim 13, wherein said marking unit includes at least one of a drying unit for drying or curing liquid ink from an ink jet marking engine and a fuser for fixing toner from an electrophotographic image marking engine.

15. A printing system according to claim 11 further comprising an electrostatic tacking device disposed along said merge portion of said transport pathway, said electrostatic tacking device operative to generate an electrostatic bond between said length of sheet media and said cut sheets of media.

16. A printing system according to claim 15 further comprising an electrostatic detacking unit disposed along said separator portion of said transport pathway, said electrostatic detacking unit operative to dissipate an electrostatic bond between said length of sheet media and said cut sheets of media.

17. A printing system according to claim 11, wherein said marking unit includes a plurality of star wheel and roller assemblies operative to engage and maintain said length of sheet media and said cut sheets of media in a substantially-fixed relative position to one another while operatively disposed along said marking unit.

18. A method of printing a multi-sheet document, said method comprising:

a) providing a length of sheet media and a quantity of pre-cut sheets of media;

b) positioning one or more of said quantity of pre-cut sheets of media along said length of sheet media;

c) moving said length of sheet media together with said pre-cut sheets of media through a printing system and thereby generating marked pre-cut sheets of media and marked portions of said length of sheet media;

d) separating said marked pre-cut sheets of media from said length of sheet media;

e) cutting at least said marked portions of said length of sheet media into individual sheets of marked media; and, f) collecting said marked pre-cut sheets of media and said individual sheets of marked media into a multi-sheet document.

19. A method according to claim 18, wherein said collecting action in f) includes interleaving said marked pre-cut sheets of media and said individual sheets of marked media into a predetermined sequence.

20. A method according to claim 19, wherein said collecting action in f) includes delaying one or more of said marked pre-cut sheets of media prior to interleaving said one or more marked pre-cut sheets of media with said individual sheets of marked media.

21. A method according to claim 18, wherein said generating action in c) includes generating unmarked portions of said length of sheet media, and said cutting action in e) includes cutting said unmarked portions of said length of sheet media into individual sheets of unmarked media.

22. A method according to claim 21, wherein said collecting action in f) includes collecting said individual sheets of unmarked media separately from said marked pre-cut sheets of media and said individual sheets of marked media.

23. A method according to claim 18 further comprising:

inverting at least one of said length of sheet media and said pre-cut sheets of media prior to said cutting action in e) such that an opposing surface of said at least one of said length of sheet media and said pre-cut sheets of media is exposed; and, moving at least said opposing surface of said at least one of said length of sheet media and said pre-cut sheets of media through a printing system and thereby generating marked images thereon.

24. A method according to claim 23, wherein said action of inverting includes inverting both said length of sheet media and said pre-cut sheets of media, and positioning said inverted pre-cut sheets of media along said inverted length of sheet media such that unmarked surfaces thereof are facing the same direction.

* * * * *